US010227724B2

(12) United States Patent
Barre et al.

(10) Patent No.: US 10,227,724 B2
(45) Date of Patent: Mar. 12, 2019

(54) HANGING LAUNDRY STORAGE CONTAINERS WITH C-SHAPED HANDLES

(71) Applicant: NEATFREAK GROUP INC., Mississauga (CA)

(72) Inventors: Bertrand Barre, Lapeyrouse (FR); Francis Lepage, Dommartin (FR)

(73) Assignee: NEATFREAK GROUP INC., Mississauga, Ontario (CA)

( * ) Notice: Subject to any disclaimer, the term of this patent is extended or adjusted under 35 U.S.C. 154(b) by 134 days.

(21) Appl. No.: 15/060,920

(22) Filed: Mar. 4, 2016

(65) Prior Publication Data

US 2017/0254016 A1 Sep. 7, 2017

(51) Int. Cl.
*A47G 29/00* (2006.01)
*D06F 95/00* (2006.01)

(52) U.S. Cl.
CPC ..... *D06F 95/004* (2013.01); *D06F 95/002* (2013.01)

(58) Field of Classification Search
CPC .... B65D 85/18; B65D 85/182; A61B 19/045; A47G 25/54; A45C 3/12; D06F 95/004
USPC ..... 206/278, 285, 286, 289, 459.5, 554; 383/13, 17, 20, 23, 25, 36, 40, 7, 117, 12, 383/121, 16; 248/95, 129, 97, 98, 99; D32/37; 220/9.1, 9.2, 9.3, 9.4
See application file for complete search history.

(56) References Cited

U.S. PATENT DOCUMENTS 3,161,391 A 12/1964 Bahnsen
3,379,367 A * 4/1968 Murcott ..... D06F 95/004 220/9.3
3,549,085 A 12/1970 Hart
4,175,602 A 11/1979 Cavalaris et al.
4,189,036 A 2/1980 Pelavin
6,302,281 B1 10/2001 Wang
6,428,208 B1 8/2002 Addison et al.
6,659,273 B1 12/2003 Scola
6,708,819 B1 3/2004 Lee
8,714,350 B2 5/2014 Berglund
8,910,813 B1 12/2014 Barre et al.
2006/0157358 A1 7/2006 Heidel
(Continued)

OTHER PUBLICATIONS

Stacks and Stacks, URL http://www.stacksandstacks.com/laundry-tote-bag, May 26, 2015, Rochester Hills, Michigan, USA.

*Primary Examiner* — Fenn C Mathew
*Assistant Examiner* — Cynthia Collado
(74) *Attorney, Agent, or Firm* — Patzik, Frank & Samotny Ltd.

(57) ABSTRACT

A removable hanging laundry storage container such as a bag or hamper including a pair of substantially C-shaped handles extending upwards from opposites sides of the top of the hamper or bag. The C-shaped handles define interior regions for receiving a horizontal support to hang the hamper or bag thereon. The handles are sized and shaped to provide for a grasping surface on the opposite side of the handle end to allow the handle to be readily grasped when the storage container is hanging from a horizontal support to facilitate the lifting of the handle and hamper off the horizontal support. The hamper or bag may have cut-away sections matching the interior of the handles to provide an open area to facilitate placement and removal of the hampers on the horizontal support.

20 Claims, 7 Drawing Sheets

(56) References Cited

U.S. PATENT DOCUMENTS

2006/0255213 A1* 11/2006 Lawson ..... D06F 95/004
248/95
2007/0183691 A1 8/2007 Finnegan

* cited by examiner

HANGING LAUNDRY STORAGE CONTAINERS WITH C-SHAPED HANDLES

BACKGROUND OF THE INVENTION

1. Field of the Invention

The present invention relates, in general, to garment storage and, more particularly, to portable laundry storage containers and sorters for storing and pre-sorting of garments prior to laundering them.

2. General Background of the Invention

Laundry hampers or bags providing a compartment or interior for receiving soiled or used garments have been known for some time. It has also been known to use multiple removable or portable laundry bags or hampers to facilitate pre-sorting of garments by type prior to washing, such as separating white, light color, and dark color fabrics, so that each pre-sorted group of garments may be loaded directly into a washing machine. The use of removable laundry bags permits individual loads of pre-sorted laundry to be separately transported for placement within a washing machine.

Prior art laundry sorters having removable laundry bags, such as the one disclosed in U.S. Pub. No. 2006/0157358 A1, are commonly top loading in construction, meaning that removal and replacement of each supported laundry bag requires that the bag must be vertically lifted above the frame, in order to clear, among other structures, a top front horizontal bar or similar structure of the frame. Particularly during removal of the laundry bags, when they may be relatively heavily loaded with garments, vertically raising the bag above the frame may be cumbersome or difficult, particularly if the user is not physically strong, is relatively short in height, or is suffering from lower back pain or other physical ailment.

Other prior art hanging laundry bags, such as the one disclosed in U.S. Pat. No. 8,714,350 B2, include separate handles or areas for grasping the laundry bag for removal of the bag from its hanging position and transporting during the washing process.

BRIEF SUMMARY OF THE INVENTION

The present invention provides laundry storage containers such as bag or hampers and sorters for the laundry storage containers that overcome many of the shortcomings of certain prior art laundry bags and sorters. In particular, hanging laundry storage containers are disclosed that include handles that are designed and shaped to both support the laundry storage containers on a horizontal support and permit a user to remove and transport the laundry storage containers without the need for separate handles or grasping surfaces.

In one embodiment of the present invention, removable laundry bags include a pair of substantially C-shaped handles extending upwards from opposites sides of the top of the bag. The C-shaped handles define interior regions for receiving a horizontal support to hang the bag thereon. The curved end of the handles prevent the hampers from sliding off the horizontal support. A grasping surface located on the opposite side of the handle end allows the handle to be grasped when the bag is positioned on the horizontal support to facilitate the lifting of the handle and bag off the support. As a result, the requirement of a separate component for removing and transporting the hamper is eliminated. The bag may have cut-away sections corresponding to the interior of the handles to provide an open area to facilitate the bag's placement on and removal from the support.

DETAILED DESCRIPTION OF THE INVENTION

Figure 1:
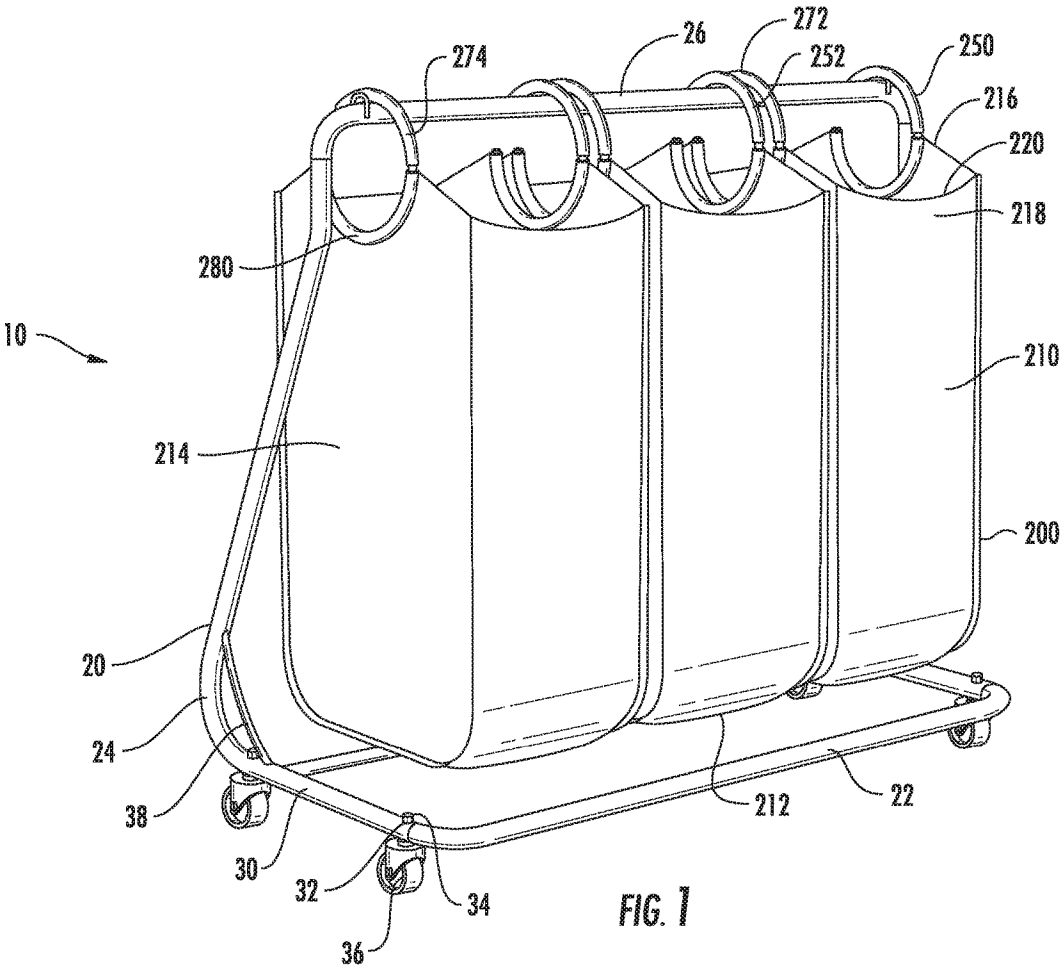
FIG. 1 is an elevated, front perspective view of an embodiment of a laundry sorter including a plurality of hanging laundry bags of the present invention.

While the present invention is susceptible of embodiment in many different forms, there is shown in the drawings and will herein be described in detail, several specific embodiments, with the understanding that the present disclosure is intended as an exemplification of the principles of the present invention and is not intended to limit the invention to the embodiments illustrated.

Figure 2:
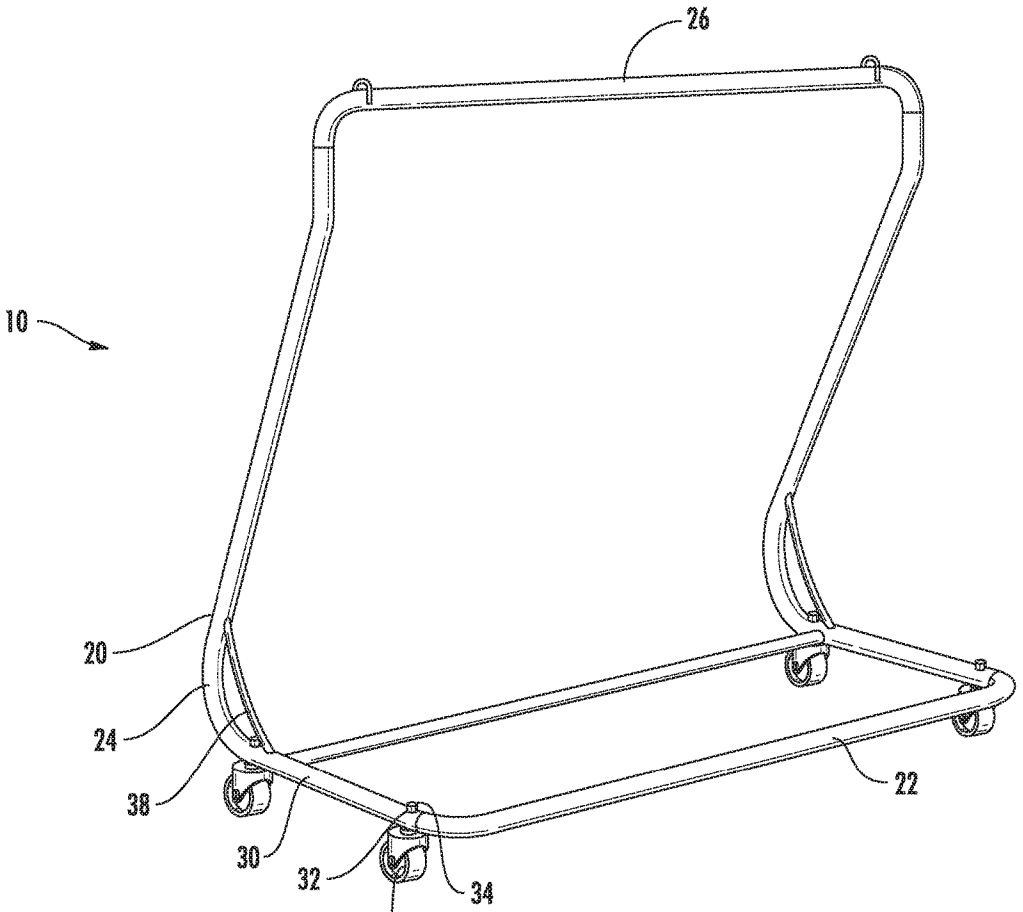
FIG. 2 is an elevated, front perspective view of the frame portion of the laundry sorter of FIG. 1.

FIGS. 1 and 2 illustrate one embodiment of a laundry sorter 10 having a plurality of hanging laundry storage containers 200 of the present invention. The sorter 10 comprises a frame 20 supporting a plurality of substantially adjacent removable hanging laundry storage containers in the form of bags 200. Frame 20 may be constructed primarily of tubular steel or aluminum components and comprises a pair of two parallel horizontal bottom tubes 22 connecting a pair of side members 24 and a horizontal top tube 26 extending between the side members 24 to form a horizontal support such as a bar or rod. Clips or other elements 42 may protrude upwards from the horizontal support 26 to help retain the bags 200 on the horizontal support 26 when in use.

As shown in FIG. 2, at least one of the bottom tubes 22 and the top tube 26 may have curved ends that matingly connect or attach to the ends of the side members 24 through a press fit, detents, bolts or other known means. The bottom 30 of each of the side members 24 may have a pair of spaced apart holes or openings 32 to attach a pair of casters 36 to the frame 20. In particular, bolts from the casters may extend therethrough and be secured in place through nuts or other fasteners 34. Alternatively, feet or other friction members may be attached to the bottom of the frame 20 to inhibit inadvertent movement of the frame 20. Side frames 24 may also include reinforcing members 38 extending between the bottom members 30 and the vertically rising member 40 to provide strength and rigidity to the frame 20.

While the figures show a frame having side members in the shape similar to an inverted question mark, it is appreciated that the frame may take any number of shapes and sizes and not depart from the scope of the present invention. Among other things, the side members may take the shape of an inverted "Y", an "A" frame, or an inverted "U" with a horizontal bar at the bottom.

Figure 3:
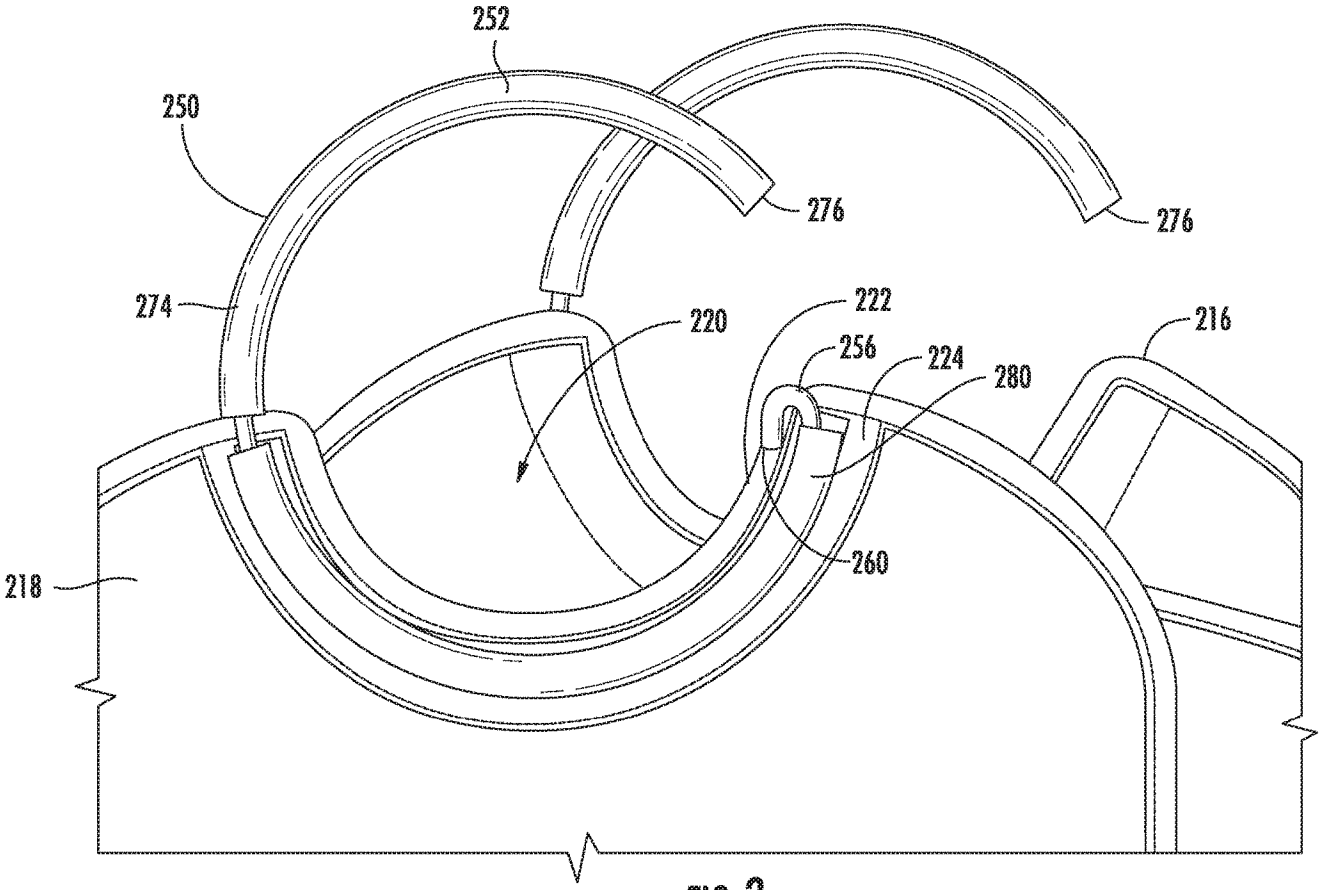
FIG. 3 is an elevated front view of the top of one of the laundry bags of FIG. 1 illustrating one embodiment of the handles of the present invention.

As best seen in FIG. 1, laundry sorter 10 includes three removable laundry bags 200, each comprising a fabric body 210 for receiving soiled laundry. While three bags are shown, it is appreciated that a different number of bags, hampers or other laundry storage containers may be used and not depart from the scope of the present invention. The fabric body includes a bottom 212 and at least one wall 214 extending from the bottom 212 to an upper edge 216 at the top 218 that defines an opening for receiving the laundry. Referring to FIG. 1, fabric body 210 may be generally cylindrically shaped with a substantially rectangular cross section, and may include internal stiffeners such as, but not limited to, flat wires, about its vertical, top and bottom edges to inhibit folding or collapsing of the fabric, such that laundry bag 200 substantially retains its general configuration. It is appreciated that collapsible/foldable metals or other materials may be used along the seams to allow the walls to fold into one another and then snap back into place to form the laundry bag. The front side of the upper edge 216 of the laundry bag may be curved downwardly to facilitate placement of garments into the laundry bag 200. Referring to FIG. 3, the sides of the top 218 of the laundry bag 200 may include curved cut away section or recess 220 therein.

Figure 4:
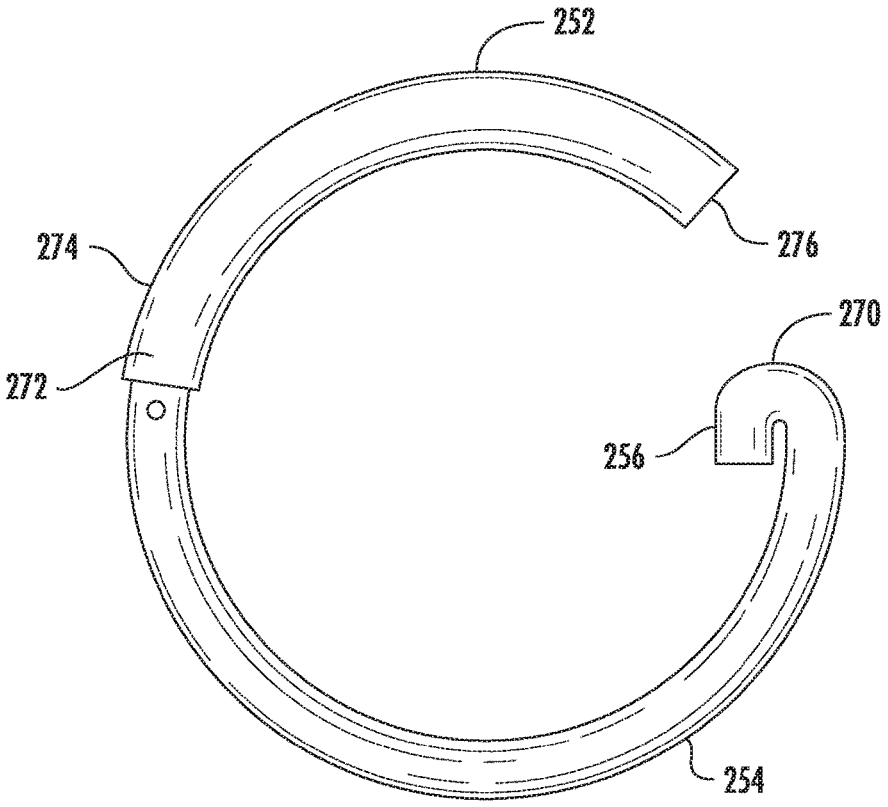
FIG. 4 is a top plan view of one of the handles of FIG. 3.

FIG. 4 illustrates one embodiment of a pair of handles 250 for use with the laundry storage bag 200. The handles 250 are substantially circular in shape with an opening sized to permit the handles 250 to be placed over and removed from the horizontal support 26. Each of the handles includes an upper curved portion 252 and a lower curved portion 254 for directly or indirectly attaching the handle to the bag 200. In one embodiment, the curvature of handle 250 extends about 320 degrees, wherein the interior of the handle 250 defines a receiving area for placement of the handles 250 and laundry bag 200 on a horizontal support 26. The upper curved member preferably has a radius of curvature that is greater than the radius of curvature of the horizontal support, which allows each of the handles to engage the top of the horizontal support. The curvature of the upper portion 252 of the handle 250 allows part of the handle 250 to project outwardly away from the plane defined by the horizontal support 26 and provides for an area 274 on the handle 250 that may be grasped by a user to lift the handle 250 off of the horizontal support 26 and maneuver the horizontal support 26 through the opening to remove the bag 200 from engagement with the horizontal support 26, thereby allowing the bag to be transported (e.g., to the laundry room or washing machine).

A pair of spaced apart seams 222, 224 may be used with a piece of fabric 226 to form a channel 280 extending through the top of each side of the laundry bag 200 for receiving the lower portion 254 of handles 250. Referring to FIG. 4, the channels may extend underneath the recess 220 in the top 218 of the laundry bag 200. In one embodiment, the opening in the C-shaped handle's lower portion corresponds to the shape and size of the recess 220 to provide a large opening in the bag 200 to facilitate its removal from the horizontal support 26. Each handle 250 may be constructed of a relatively rigid material such as steel or aluminum. The end 270 of handle 250 may include a hook or curved end 256 that extends back over the channel thereon or be folded back toward itself to help secure handle 250 relative to the laundry bag 200. A slot 262 may be used proximate to the upper or lower seam 222, 224 to receive part of the end of the hook 256.

A sleeve or coating 272 may be placed over the upper portion 252 of the handle 250 to provide a slip-resistant surface for grasping the handle 250 and for interacting with the horizontal support 26. The surface may be cushioned for comfort. Examples of materials for the sleeve or coating may include, but are not limited to foam, thermoplastic elastomers, synthetics or polymers. The sleeve 272 may be attached or applied to the handle 250 in any known way, including, but not limited to, over-molding the sleeve onto the handle, or fastened using adhesives, welding or screws or other fasteners. By providing a cushioned material on the handle, a user can more easily grasp the area 274 of the handle on the side opposite the end 276 to facilitate placement and removal of the laundry bag 200 on the horizontal support 26. Accordingly, each laundry bag does not need a separate handle or grasping area to place or remove the laundry bag on or from the horizontal support.

Figure 5:
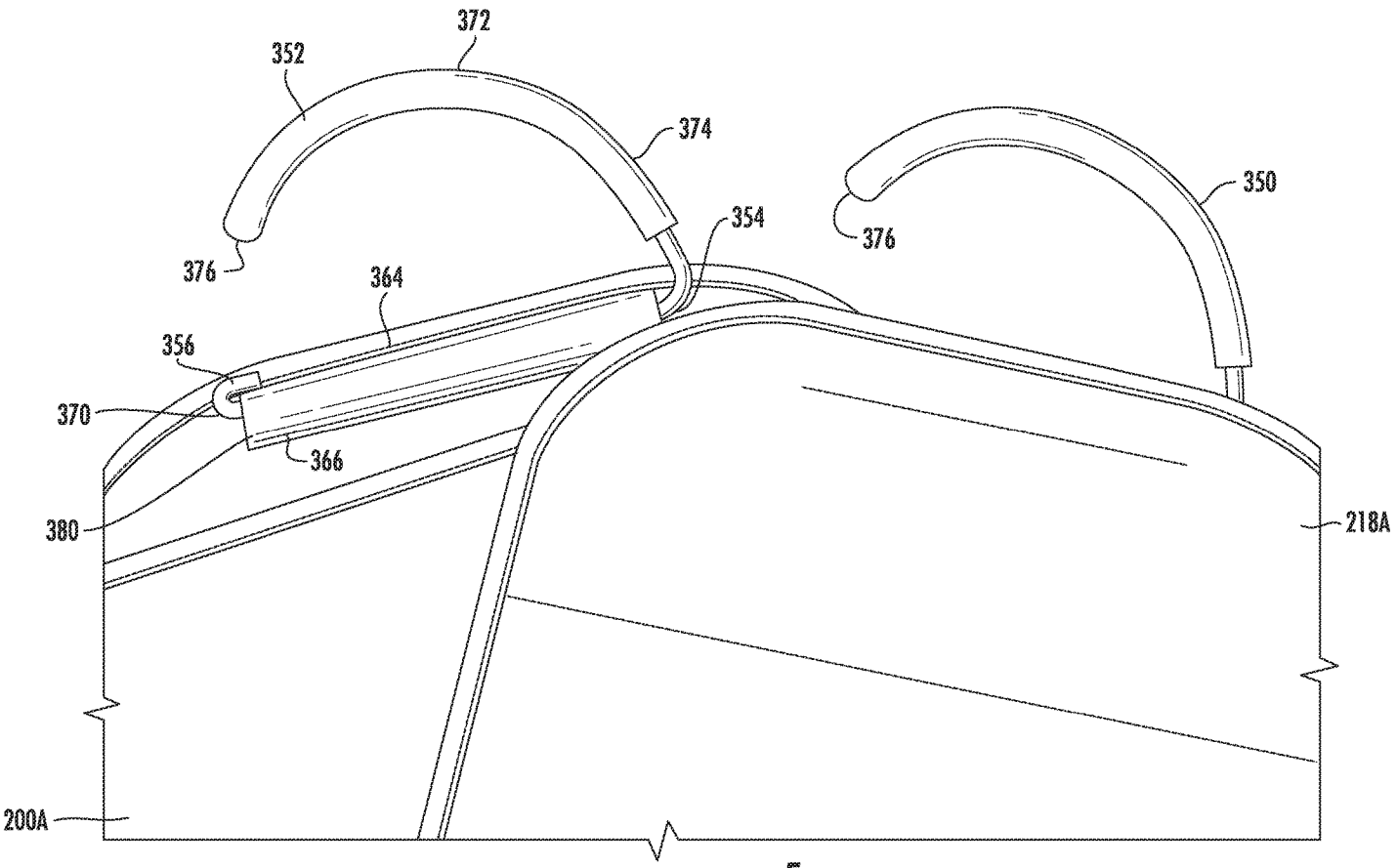
FIG. 5 is an elevated front view of the top of a laundry bag showing a second embodiment of the handles of the present invention.
Figure 6:
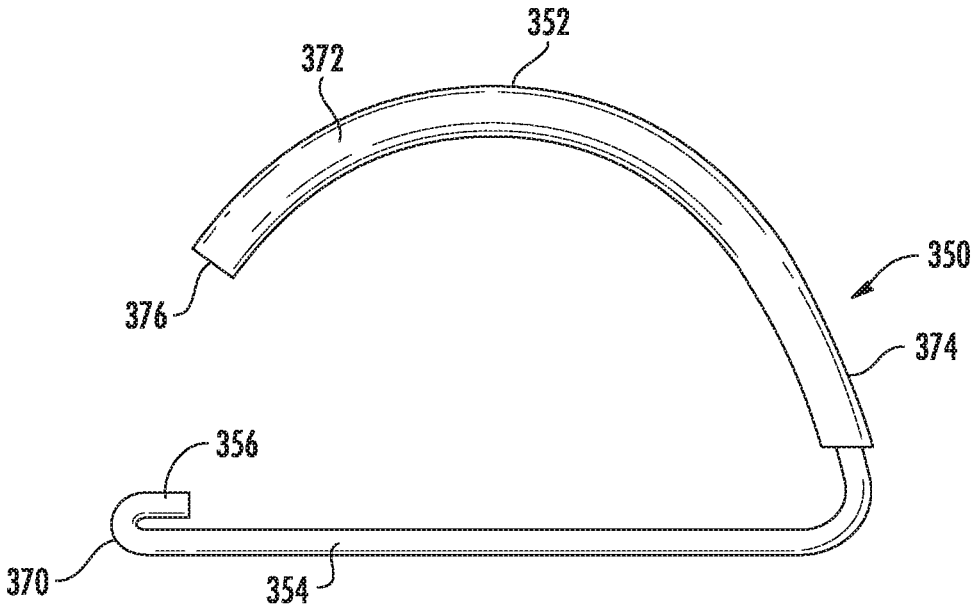
FIG. 6 is a top plan view of one of the handles of FIG. 5.

Referring to FIGS. 5 and 6, a second embodiment of a handle of the present invention is disclosed. Each of the pair of handles 350 for a laundry bag **200*a* is substantially D-shaped with a curved upper portion 352 and a lower straight portion 354. Straight portion 354 is sized to fit within channel 380 formed at the top 218*a* of the sides of the laundry bag 200*a* by a piece of material attached along its length by a pair of seams 364, 366. The end 370 of the straight portion 354 may include a hook or curved end 356 that extends back over the channel 380 when the straight portion 354 is positioned within the channel 380 to help retain the handle 350 in place. A slot may be used proximate to the upper or lower seam 364, 366 to receive part of the end of the hook 356**.

The upper portion of the handle may be curved in the shape of a partial circle. Referring to FIG. 4, in one embodiment, the curvature of upper portion extends about 140 degrees, wherein the interior of the handle defines a receiving area for placement of the handles and laundry bag on a horizontal support.

A sleeve or coating 372 may be placed over the upper portion 352 of the handle 350 to provide a slip-resistant surface for grasping the handle 350 and for interacting with the horizontal support 26. The surface may be cushioned for comfort. Examples of materials for the sleeve or coating may include, but are not limited to foam, thermoplastic elastomers, synthetics or polymers. The sleeve 372 may be attached or applied to the handle 350 in any known way, including, but not limited to, over-molding the sleeve onto the handle, or fastened using adhesives, welding or screws or other fasteners. By providing a cushioned material on the handle, a user can more easily grasp the area 374 of the handle on the side opposite the end 376 to facilitate placement and removal of the laundry bag **200*a* on the horizontal support 26**. Accordingly, each laundry bag does not need a separate handle or grasping area to place or remove the laundry bag on or from the horizontal support.

Figure 7:
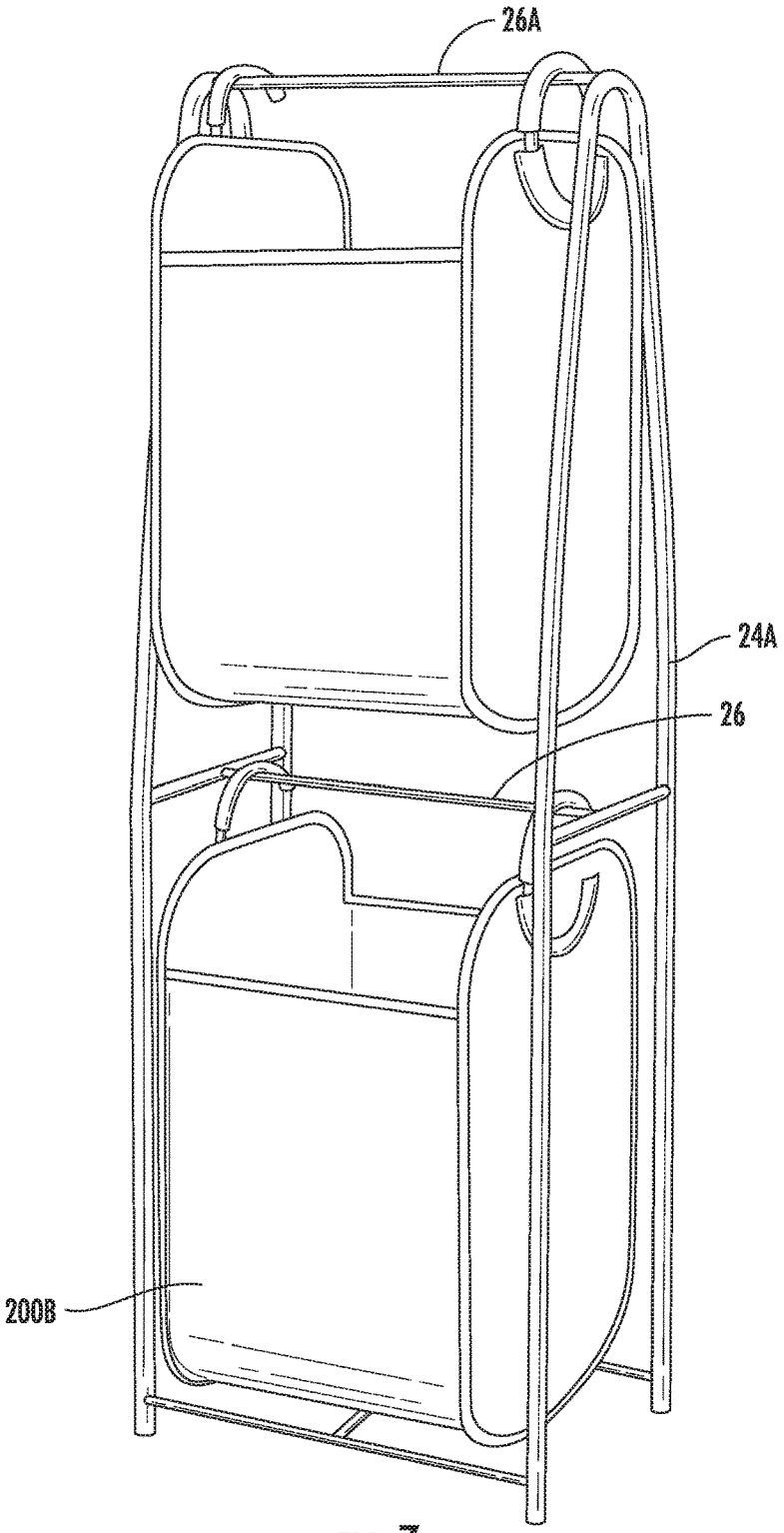
FIG. 7 is a front perspective view of another embodiment of a laundry sorter including a pair of hanging laundry bags vertically positioned relative to one another on a frame.

Although the previously described embodiment discloses a laundry sorter consisting of three laundry bags 200, different sized laundry sorts having different numbers of supported bags are also contemplated by the present invention. For example, referring to FIG. 7, the frame may include a pair of horizontal supports 26, **26*a* extending between elongated side members 24*a* to allow a pair of laundry bags 200*b*** to be placed in a vertically spaced position relative to one another. It is appreciated that any of the laundry bags disclosed or taught herein may be used in connection with the sorters.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of performing the various steps of the invention disclosed herein without departing from the spirit and scope of the invention. The present disclosure is intended to exemplify and not limit the invention.

What is claimed is:

1. A portable laundry storage container for removable placement on a cylindrical horizontal support for receiving soiled or used garments, the horizontal support having a first radius of curvature and defining a vertical plane therethrough, the storage container comprising:

a body comprising:

a bottom;

a top having an upper edge defining an opening for receiving garments; and at least one wall extending between the bottom and the upper edge of the top;

a pair of handles attached on opposite portions of the top of the body, each of the pair of handles comprising a lower portion for connecting the handle relative to the body and an upper curved portion defining a receiving area for placement of the handle onto the horizontal support, the lower portion and upper portion having ends that are spaced apart to permit movement of the horizontal support between the ends, the upper curved portion having a second radius of curvature greater than the first radius of curvature, wherein the upper curved portion further comprises a grasping area that is offset from the vertical plane of the horizontal support to allow a user to grasp the handle when the handle is resting on the horizontal support, wherein the laundry storage container is removable from the horizontal support without detaching the handles from the laundry storage container.

2. The portable laundry storage container of claim 1 wherein the upper curved portion extends from proximate the upper edge of the body.

3. The portable laundry storage container of claim 1 wherein the handle includes a sleeve around part of the upper curved portion.

4. The portable laundry storage container of claim 3 wherein the sleeve is made from a thermoplastic elastomer.

5. The portable laundry storage container of claim 1 wherein the pair of handles are substantially C-shaped.

6. The portable laundry storage container of claim 5 wherein the opposite sides of the top of the body include recesses substantially aligned with the receiving areas of the pair of handles.

7. The portable laundry storage container of claim 1 wherein the lower portion of each of the handles is substantially straight.

8. The portable laundry storage container of claim 7 wherein the body further includes channels proximate the upper edge at the opposite sides of the top of the body for receiving at least a portion of the lower portions.

9. A portable laundry storage container for removable placement on a cylindrical horizontal support for receiving soiled or used garments, the horizontal support having a first radius of curvature and defining a vertical plane therethrough, the storage container comprising:

a body comprising:

a bottom;

a top having an upper edge defining an opening for receiving garments; and at least one wall extending between the bottom and the upper edge of the top;

a pair of handles attached on opposite portions of the top of the body, each of the pair of handles comprising a lower portion for connecting the handle relative to the body and an upper curved portion defining a receiving area for placement of the handle onto the horizontal support, the lower portion and upper portion having ends that are spaced apart to permit movement of the horizontal support between the ends, the upper curved portion having a second radius of curvature greater than the first radius of curvature, wherein the upper curved portion further comprises a grasping area that is offset from the vertical plane of the horizontal support to allow a user to grasp the handle when the handle is resting on the horizontal support;

wherein the pair of handles are substantially C-shaped;

wherein the opposite sides of the top of the body include recesses substantially aligned with the receiving areas of the pair of handles; and wherein the body further includes channels beneath the recesses for receiving at least a portion of the lower portions.

10. The portable laundry storage container of claim 9 wherein the end of each lower portion is curved back towards the lower portion for securing the handle in place relative to the body.

11. The portable laundry storage container of claim 9 wherein the handle includes a sleeve around part of the upper curved portion.

12. The portable laundry storage container of claim 11 wherein the sleeve is made from a thermoplastic elastomer.

13. A portable laundry storage container for removable placement on a cylindrical horizontal support for receiving soiled or used garments, the horizontal support having a first radius of curvature and defining a vertical plane therethrough, the storage container comprising:

a body comprising:

a bottom;

a top having an upper edge defining an opening for receiving garments; and at least one wall extending between the bottom and the upper edge of the top;

a pair of handles attached on opposite portions of the top of the body, each of the pair of handles comprising a lower portion for connecting the handle relative to the body and an upper curved portion defining a receiving area for placement of the handle onto the horizontal support, the lower portion and upper portion having ends that are spaced apart to permit movement of the horizontal support between the ends, the upper curved portion having a second radius of curvature greater than the first radius of curvature, wherein the upper curved portion further comprises a grasping area that is offset from the vertical plane of the horizontal support to allow a user to grasp the handle when the handle is resting on the horizontal support;

wherein the lower portion of each of the handles is substantially straight;

wherein the body further includes channels proximate the upper edge at the opposite sides of the top of the body for receiving at least a portion of the lower portions; and wherein the end of each lower portion is curved back towards the lower portion for securing the handle in place relative to the body.

14. A laundry sorter for receiving soiled or used garments, the laundry sorter comprising:

a frame comprising a base, a pair of side members connected to the base and a cylindrical horizontal support extending between the pair of side members, the top member having a first radius of curvature and defining a vertical plane extending therethrough; and at least one laundry storage container comprising:

a body having a bottom;

a top having an upper edge defining an opening for receiving garments; and at least one wall extending between the bottom and the upper edge of the top; and a pair of handles attached on opposite portions of the top of the body, each of the pair of handles comprising a lower portion for connecting the handle relative to the body and an upper curved portion defining a receiving area for placement of the handle onto the horizontal support, the lower portion and upper portion having ends that are spaced apart to permit movement of the horizontal support between the ends, the upper curved portion having a second radius of curvature greater than the first radius of curvature, wherein the upper curved portion further comprises a grasping area that is offset from the vertical plane of the horizontal support to allow a user to grasp the handle when the handle is resting on the horizontal support, wherein the laundry storage container is removable from the horizontal support without detaching the handles from the laundry storage container.

15. The laundry sorter of claim 14 wherein the at least one laundry storage container comprises two laundry storage containers, and wherein the frame further comprises a second cylindrical horizontal support extending between the pair of side members in vertically spaced relation to the first horizontal support to permit the two laundry storage containers to be positioned on the horizontal supports in vertically spaced relation relative to one another.

16. The laundry sorter of claim 14 wherein the pair of handles are substantially C-shaped.

17. The laundry sorter of claim 16 wherein the opposite portions of the top of the body include recesses substantially aligned with the receiving areas of the pair of handles.

18. The laundry sorter of claim 14 wherein the handle includes a sleeve around part of the upper curved portion.

19. A laundry sorter for receiving soiled or used garments, the laundry sorter comprising:

a frame comprising a base, a pair of side members connected to the base and a cylindrical horizontal support extending between the pair of side members, the top member having a first radius of curvature and defining a vertical plane extending therethrough; and at least one laundry storage container comprising:

a body having a bottom;

a top having an upper edge defining an opening for receiving garments; and at least one wall extending between the bottom and the upper edge of the top; and a pair of handles attached on opposite portions of the top of the body, each of the pair of handles comprising a lower portion for connecting the handle relative to the body and an upper curved portion defining a receiving area for placement of the handle onto the horizontal support, the lower portion and upper portion having ends that are spaced apart to permit movement of the horizontal support between the ends, the upper curved portion having a second radius of curvature greater than the first radius of curvature, wherein the upper curved portion further comprises a grasping area that is offset from the vertical plane of the horizontal support to allow a user to grasp the handle when the handle is resting on the horizontal support;

wherein the pair of handles are substantially C-shaped;

wherein the opposite portions of the top of the body include recesses substantially aligned with the receiving areas of the pair of handles; and wherein the at least one laundry storage container further comprises channels beneath the recesses for receiving at least a portion of the lower portions.

20. The laundry sorter of claim 19 wherein the end of each lower portion is curved back towards the lower portion for securing the handle in place relative to the body.

* * * * *